US006444057B1

(12) United States Patent
Darolia et al.

(10) Patent No.: US 6,444,057 B1
(45) Date of Patent: Sep. 3, 2002

(54) COMPOSITIONS AND SINGLE-CRYSTAL ARTICLES OF HAFNIUM-MODIFIED AND/OR ZIRCONIUM-MODIFIED NICKEL-BASE SUPERALLOYS

(75) Inventors: Ramgopal Darolia, West Chester; Jeffrey A. Pfaendtner, Blue Ash; William S. Walston, Maineville, all of OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/318,636

(22) Filed: May 26, 1999

(51) Int. Cl.[7] ..... C22C 19/05
(52) U.S. Cl. ..... 148/428; 420/448
(58) Field of Search ..... 420/448; 148/428

(56) References Cited

U.S. PATENT DOCUMENTS

| | | | | |
|---|---|---|---|---|
| 4,292,076 A | * | 9/1981 | Gigliotti et al. | 75/170 |
| 4,719,080 A | * | 1/1988 | Duhl et al. | 420/443 |
| 4,915,907 A | * | 4/1990 | Shah et al. | 420/448 |
| 5,482,789 A | | 1/1996 | O'Hara et al. | 428/652 |
| 5,759,301 A | | 6/1998 | Konter et al. | 148/404 |
| 6,007,645 A | * | 12/1999 | Cetel et al. | 148/404 |

FOREIGN PATENT DOCUMENTS

| | | |
|---|---|---|
| EP | 0637476 A | 2/1995 |
| WO | 99/21680 | 5/1999 |

OTHER PUBLICATIONS

Superalloys Resist Hot Corrosion and Oxidation, by Gary L. Erickson, pp. 27–30 XP000680886 Advanced Material s & Processes Mar. 1997.

* cited by examiner

*Primary Examiner*—Roy King
*Assistant Examiner*—Harry D. Wilkins, III
(74) *Attorney, Agent, or Firm*—David L. Narciso; Gregory O. Garmong

(57) ABSTRACT

An article is formed of a single crystal having a composition, in weight percent, of a modifying element in an amount of from about 0.2 to about 2.0 percent by weight hafnium, from about 0.1 to about 0.5 percent by weight zirconium, or combinations thereof, and a base alloy composition of from about 4 to about 20 percent cobalt, from about 1 to about 10 percent chromium, from about 5 to about 7 percent aluminum, from 0 to about 2 percent molybdenum, from about 3 to about 8 percent tungsten, from about 4 to about 12 percent tantalum, from 0 to about 2 percent titanium, from 0 to about 8 percent rhenium, from 0 to about 6 percent ruthenium, from 0 to about 1 percent niobium, from 0 to about 0.1 percent carbon, from 0 to about 0.01 percent boron, from 0 to about 0.1 percent yttrium, and balance nickel and incidental impurities.

24 Claims, 2 Drawing Sheets

COMPOSITIONS AND SINGLE-CRYSTAL ARTICLES OF HAFNIUM-MODIFIED AND/OR ZIRCONIUM-MODIFIED NICKEL-BASE SUPERALLOYS

BACKGROUND OF THE INVENTION

This invention relates to single-crystal articles made of nickel-base superalloys, and, more particularly, to such articles whose compositions are modified with additions of hafnium and/or zirconium to achieve improved properties.

In an aircraft gas turbine (jet) engine, air is drawn into the front of the engine, compressed by a shaft-mounted compressor, and mixed with fuel. The mixture is combusted, and the resulting hot exhaust gases are passed through a turbine mounted on the same shaft. The flow of gas turns the turbine, which turns the shaft and provides power to the compressor. The hot exhaust gases flow from the back of the engine, driving it and the aircraft forwardly.

The hotter the exhaust gases, the more efficient is the operation of the jet engine. There is thus an incentive to raise the exhaust gas temperature. However, the maximum temperature of the exhaust gases is normally limited by the materials used to fabricate the turbine vanes and turbine blades of the turbine. In current engines, the turbine vanes and blades are made of nickel-based superalloys and can operate at temperatures of up to 1900–2100° F.

Many approaches have been used to increase the operating temperature limits and operating lives of the turbine blades and vanes. The compositions and processing of the materials themselves have been improved. The articles may be prepared as oriented single crystals to take advantage of superior properties observed in certain crystallographic directions. Physical cooling techniques are used. In one widely used approach, internal cooling channels are provided within the components, and cool air is forced through the channels during engine operation. Protective coatings may be applied to the surfaces of the turbine blades and vanes.

Specific alloys have been developed for use in single-crystal turbine blades and vanes. Examples include nickel-base superalloys known as Rene' N5, Rene' N6. CMSX-4. CMSX-10, PWA 1480, PWA 1484, and MX-4.

These superalloys exhibit improved properties as compared with conventional alloys, but there is always a need for further improvements to the strengths, elevated temperature capabilities, operating lifetimes, and stabilities of the alloys used in single-crystal article applications. The present invention fulfills this need, and further provides related advantages.

SUMMARY OF THE INVENTION

The present invention provides nickel-base superalloy single crystal articles having compositions that exhibit improved mechanical properties for high-temperature applications. The invention is therefore applied most beneficially to articles used in high-temperature applications, such as aircraft gas turbine blades and vanes. The alloy modifications to the nickel-base superalloys are selected so that other properties of the alloys, such as castability and heat treatability, are not adversely affected. The alloy of the invention is also compatible with the use of both diffusion and overlay protective coatings and thermal barrier coatings.

An article comprises substantially a single crystal. The article has a composition, in weight percent, consisting essentially of (a) a modifying element selected from the group consisting of from about 0.2 to about 2.0 percent by weight hafnium, and from about 0.1 to about 0.5 percent by weight zirconium, and combinations thereof, and (b) a base alloy composition of from about 4 to about 20 percent cobalt, from about 1 to about 10 percent chromium, from about 5 to about 7 percent aluminum, from 0 to about 2 percent molybdenum, from about 3 to about 8 percent tungsten, from about 4 to about 12 percent tantalum, from 0 to about 2 percent titanium, from 0 to about 8 percent rhenium, from 0 to about 6 percent ruthenium, from 0 to about 1 percent niobium, from 0 to about 0.1 percent carbon, from 0 to about 0.01 percent boron, from 0 to about 0.1 percent yttrium, balance nickel and incidental impurities.

The hafnium and/or zirconium modifying elements are added to the base alloy composition in a specific narrow range such that the benefits of their increased levels on the mechanical properties of the article are not overshadowed by any adverse effects on other properties such as castability, stability, and/or heat treatability. The modifying element is present in the superalloy composition in an amount of from about 0.2 to about 2.0 percent by weights preferably about 1.0 percent by weight, for the case of hafnium; and/or in an amount of from about 0.1 to about 0.5 percent by weight, preferably about 0.25 percent by weight, for the case of zirconium. Combinations of hafnium and zirconium within these ranges are operable.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
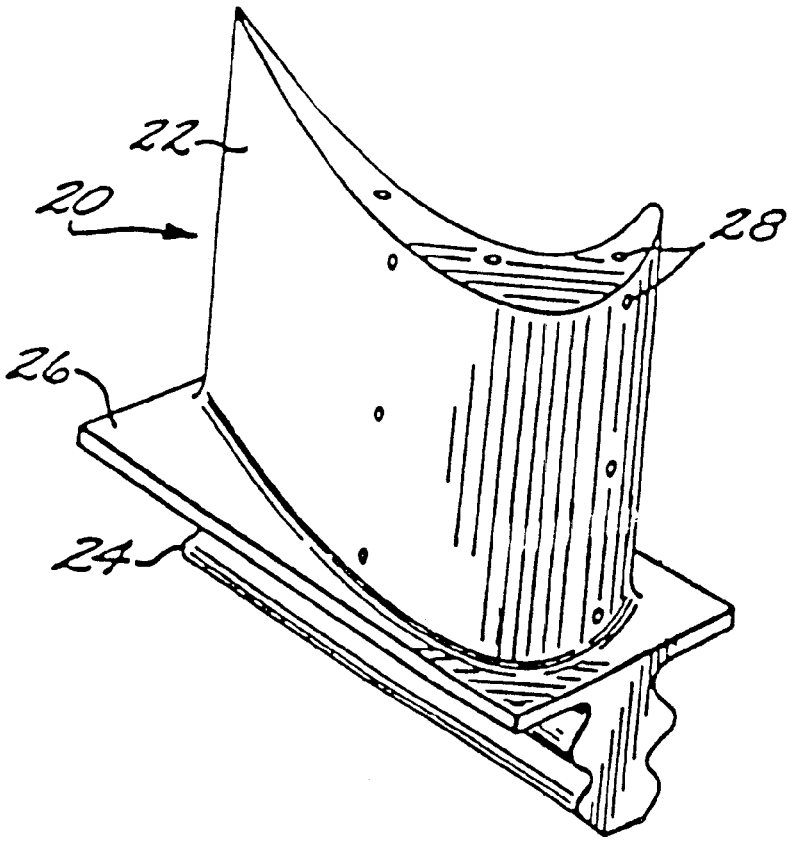
FIG. 1 is a perspective view of a turbine blade.

FIG. 1 depicts a component article of a gas turbine engine such as a turbine blade or turbine vane, and in this illustration a turbine blade 20. The turbine blade 20 includes an airfoil 22 against which the flow of hot exhaust gas is directed. (The turbine vane has a similar appearance in respect to the pertinent airfoil portion.) At least the airfoil 22, and preferably the entire turbine blade 20, is substantially single crystal. That is, there are substantially no grain boundaries in the single crystal portion, and the crystallographic orientation is the same throughout. The term "substantially single crystal" means that virtually the entire article is a single crystal, although there may be some incidental small regions having other crystalline orientations present. Even a substantially single crystal article typically has a number of low-angle grain boundaries present, and these are permitted within the scope of the term "substantially single crystal".

The article must be substantially a single crystal (i.e., single grain). It may not be a polycrystal, either a random polycrystal or an oriented polycrystal such as produced by directional solidification. In the polycrystalline alloys, it has been conventional to add higher levels of elements that are known to strengthen grain boundaries, such as carbon, boron, hafnium, and zirconium. Zirconium and hafnium are chemically reactive, modify, the morphologies of precipitate phases, and may adversely affect the heat treatment of the alloys. Because these elements are not needed to strength high-angle grain boundaries. Which are not present in substantially single-crystal articles, it has therefore been the prior practice to omit them from single-crystal articles except in very minor amounts to strengthen the low-angle grain boundaries that may be present.

The turbine blade 20 is mounted to a turbine disk (not shown) by a dovetail 24 which extends downwardly from the airfoil 22 and engages a slot on the turbine disk. A platform 26 extends longitudinally outwardly from the area where the airfoil 22 is joined to the dovetail 24. In some articles, a number of cooling channels extend through the interior of the airfoil 22, ending in openings 28 in the surface of the airfoil 22. A flow of cooling air is directed through the cooling channels, to reduce the temperature of the airfoil 22.

The article is formed of a modified base alloy composition, having a base alloy composition and a modifying element. As used herein,. "nickel-base" means that the composition has more nickel present than any other element. The preferred base alloy has a composition, in weight percent, of from about 4 to about 20 percent cobalt, from about 1 to about 10 percent chromium, from about 5 to about 7 percent aluminum, from 0 to about 2 percent molybdenum, from about 3 to about 8 percent tungsten, from about 4 to about 12 percent tantalum, from 0 to about 2 percent titanium, from 0 to about 8 percent rhenium, from 0 to about 6 percent ruthenium, from 0 to about 1 percent niobium, from 0 to about 0.1 percent carbon, from 0 to about 0.01 percent boron, from 0 to about 0.1 percent yttrium, from 0 to about 0.15 percent hafnium, balance nickel and incidental impurities.

A most preferred base alloy composition is Rene' N5, which has a nominal composition in weight percent of about 7.5 percent cobalt, about 7 percent chromium, about 6.2 percent aluminum, about 6.5 percent tantalum, about 5 percent tungsten, about 1.5 percent molybdenum, about 3 percent rhenium, about 0.05 percent carbon, about 0.004 percent boron, about 0.15 percent hafnium, up to about 0.01 percent yttrium balance nickel and incidental impurities. Other operable superalloys include, for example, Rene' N6, which has a nominal composition in weight percent of about 12.5 percent cobalt, about 4.2 percent chromium, about 1.4 percent molybdenum, about 5.75 percent tungsten, about 5.4 percent rhenium, about 7.2 percent tantalum, about 5.75 percent aluminum, about 0.15 percent hafnium, about 0.05 percent carbon, about 0.004 percent boron, about 0.01 percent yttrium, balance nickel and incidental impurities: CMSX-4, which has a nominal composition in weight percent of about 9.60 percent cobalt, about 6.6 percent chromium, about 0.60 percent molybdenum, about 6.4 percent tungsten, about 3.0 percent rhenium, about 6.5 percent tantalum, about 5.6 percent aluminum, about 1.0 percent titanium, about 0.10 percent hafnium, balance nickel and incidental impurities; CMSX-10, which has a nominal composition in weight percent of about 7.00 percent cobalt, about 2.65 percent chromium, about 0.60 percent molybdenum, about 6.40 percent tungsten, about 5.50 percent rhenium, about 7.5 percent tantalum, about 5.80 percent aluminum, about 0.80 percent titanium, about 0.06 percent hafnium, about 0.4 percent niobium, balance nickel and incidental impurities; PWA1480, which has a nominal composition in weight percent of about 5.00 percent cobalt, about 10.0 percent chromium, about 4.00 percent tungsten, about 12.0 percent tantalum, about 5.00 percent aluminum, about 1.5 percent titanium, balance nickel and incidental impurities; PWA1484, which has a nominal composition in weight percent of about 10.00 percent cobalt, about 5.00 percent chromium, about 2.00 percent molybdenum, about 6.00 percent tungsten, about 3.00 percent rhenium, about 8.70 percent tantalum, about 5.60 percent aluminum, about 0.10 percent hafnium, balance nickel and incidental impurities; and MX-4, which has a nominal composition as set forth in U.S. Pat. No. 5.482,789, in weight percent, of from about 0.4 to about 6.5 percent ruthenium, from about 4.5 to about 5.75 percent rhenium, from about 5.8 to about 10.7 percent tantalum, from about 4.25 to about 17.0 percent cobalt, from 0 to about 0.05 percent hafnium, from 0 to about 0.06 percent carbon, from 0 to about 0.01 percent boron, from 0 to about 0.02 percent yttrium, from about 0.9 to about 2.0 percent molybdenum, from about 1.25 to about 6.0 percent chromium, from 0 to about 1.0 percent niobium, from about 5.0 to about 6.6 percent aluminum, from 0 to about 1.0 percent titanium, from about 3.0 to about 7.5 percent tungsten, and wherein the sum of molybdenum plus chromium plus niobium is from about 2.15 to about 9.0 percent, and wherein the sum of aluminum plus titanium plus tungsten is from about 8.0 to about 15.1 percent, balance nickel and incidental impurities. The use of the present invention is not limited to these preferred alloys, and has broader applicability. Each of these seven compositions, when modified by the hafnium and/or zirconium modifying element, is novel.

The modifying element is present in an amount of from about 0.2 to about 2.0 percent by weight, preferably about 1.0 percent by weight, for the case of hafnium; and/or in an amount of from about 0.1 to about 0.5 percent by weight, preferably about 0.25 percent by weight, for the case of zirconium. If the amount of the addition is less than the indicated minimum in each case, there is an insubstantial advantageous effect on the mechanical properties of the article. If the amount of the addition is greater than the indicated maximum in each case, the mechanical and/or physical properties of the substrate are adversely affected. Other properties such as castability, heat treatability, and the ability to use protective coatings are also adversely affected if the amount of the addition is greater than the indicated maximum.

As indicated, the hafnium or zirconium may not be present in the modified nominal nickel-base superalloy composition in an amount that would have a substantial adverse effect on the mechanical and/or physical properties of the base alloy composition in its service application. For these same reasons, only hafnium and zirconium have been determined to be candidates for the modifying element. Other elements which may potentially improve the properties of the alloy must be added to the base composition in too great a concentration to be acceptable. For example, the amount of silicon necessary to impart beneficial effects to the properties of the article would require its concentration to be so large that it would adversely affect the properties of the alloy through increased long-term microstructural instability. The amount of yttrium necessary to impart beneficial effects to the properties of the article would require its concentration to be so large in the alloy that it would cause excessive incipient melting during solution heat treat. Silicon and yttrium additions to the base composition therefore do not come within the scope of the present invention.

For all of the compositions set forth above where the modifying element is hafnium, in the modified base alloy composition the nominal hafnium content of the base alloy composition is replaced by the hafnium content in its specified range of from about 0.2 to about 2.0 percent by weight. Where the modifying element is zirconium, in the modified base alloy composition the zirconium content is as stated within its specified range of from about 0.1 to about 0.5 percent by weight and the hafnium content is as indicated for the base alloy composition. Where the modifying element is a combination of hafnium and zirconium, in the modified base alloy composition the nominal hafnium content of the base alloy composition is replaced by the hafnium content in its specified range of from about 0.2 to about 2.0 percent by weight and the zirconium content is as stated within its specified range of from about 0.1 to about 0.5 percent by weight.

Thus, for example, a first preferred modified (hafnium-modified) nominal Rene' N5 composition, in weight percent, is about 7.5 percent cobalt, about 7 percent chromium, about 6.2 percent aluminum, about 6.5 percent tantalum, about 5 percent tungsten, about 1.5 percent molybdenum, about 3 percent rhenium, about 0.05 percent carbon, about 0.004 percent boron, up to 0.01 percent yttrium, about 1.0 percent hafnium, balance nickel and incidental impurities. A second preferred modified (zirconium-modified) nominal Rene' N5 composition, in weight percent, is about 7.5 percent cobalt, about 7 percent chromium, about 6.2 percent aluminum, about 6.5 percent tantalum, about 5 percent tungsten, about 1.5 percent molybdenum, about 3 percent rhenium, about 0.05 percent carbon, about 0.004 percent boron, up to 0.01 percent yttrium, about 0.15 weight percent hafnium, and about 0.25 percent zirconium, balance nickel and incidental impurities. A third preferred modified (hafnium plus zirconium modified) nominal Rene' N5 composition, in weight percent, is about 7.5 percent cobalt, about 7 percent chromium, about 6.2 percent aluminum, about 6.5 percent tantalum, about 5 percent tungsten, about 1.5 percent molybdenum, about 3 percent rhenium, about 0.05 percent carbon, about 0.004 percent boron, up to 0.01 percent yttrium, about 1.0 percent hafnium, and about 0.25 percent zirconium, balance nickel and incidental impurities.

Figure 2:
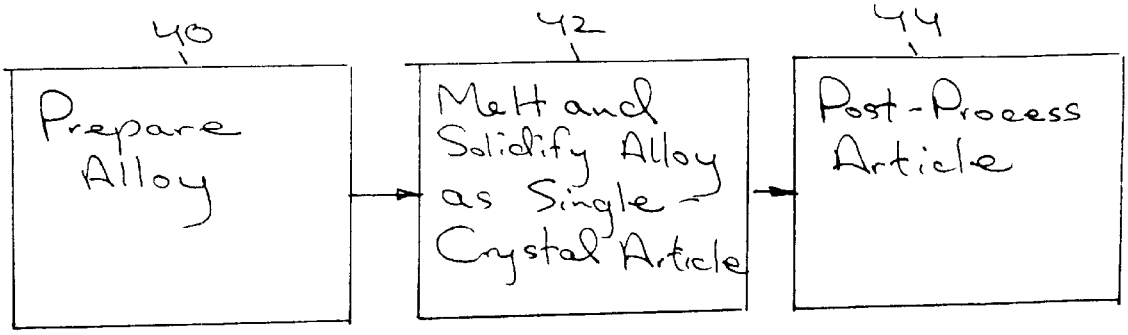
FIG. 2 is a block-flow diagram of an approach for preparing an article.

FIG. 2 illustrates a preferred method for practicing the approach of the invention. An alloy having the composition set forth above is prepare, numeral 40. The alloy is melted and solidified as substantially a single crystal, numeral 42. Techniques for solidifying single crystal articles are well known in the art. Generally, they involve solidifying the alloy in a mold unidirectionally from one end of the article, with a seed or growth constriction defining the single crystal orientation that is desired in the article. In most cases, the article is prepared with a [001] crystallographic direction parallel to a long axis of the article in the case of the turbine blade or turbine vane. After solidification as a single crystal, the article is post processed, numeral 44, by any operable technique. Post processing may include, for example, heat treating the article to optimize the mechanical properties of the alloy and/or machining the article.

The present invention has been reduced to practice. The following examples illustrate some characteristics of the alloys, but should not be interpreted as limiting of the invention in any respect.

Test specimens were prepared of the Rene N5 nominal base alloy composition as set forth above, and six compositions having the Rene N5 nominal base alloy composition plus, respectively, 0.64 weight percent hafnium, 1.06 weight percent hafnium, 1.33 weight percent hafnium, 0.2 weight percent zirconium, 0.5 weight percent zirconium, or 0.75 weight percent zirconium. All of these alloys were easily made into single crystal slabs without any reaction with the mold materials, an important consideration for production operations. The compositions were heat treated at a temperature of 2200–2400° F. for up to 16 hours.

Specimens were also prepared of some of the compositions for the evaluation of mechanical properties in stress rupture testing. (No testing was performed for the 0.5 weight percent zirconium and 0.75 weight percent zirconium compositions.) In a first test protocol, specimens were tested at 1800° F. and 30,000 pounds per square inch stress. In a second test protocol, specimens were tested at 2000° F. and 16,000 pounds per square inch stress. The number of hours to failure for each test protocol is set forth in the following table, with each data entry being the average of four tests.

| Specimen Identification | First protocol, hours | Second protocol, hours |
|---|---|---|
| Rene N5 | 300 | 400 |
| Rene N5 + 0.64 percent hafnium | 342 | 771 |
| Rene N5 + 1.06 percenr hafnium | 329 | 454 |
| Rene N5 + 1.33 percent hafnium | 294 | 236 |
| Rene N5 + 0.2 percent zirconium | 348 | 504 |

From this data and other information, the limitations on the hafnium and zirconium contents as set forth above were established.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. An article comprising substantially a single crystal and having a composition, in weight percent, consisting essentially of a modifying element selected from the group consisting of from about 0.25 to about 0.5 percent by weight zirconium, combinations of from about 0.2 to about 2.0 percent by weight hafnium and from about 0.25 to about 0.5 percent by weight zirconium, and combinations of from about 1.0 to about 2.0 percent by weight hafnium and from about 0.1 to about 0.5 percent by weight zirconium; and a base alloy composition of from about 4 to about 20 percent cobalt, from about 1 to about 10 percent chromium, from about 5 to about 7 percent aluminum, from 0 to about 2 percent molybdenum, from about 3 to about 8 percent tungsten, from about 4 to about 12 percent tantalum, from 0 to about 2 percent titanium, from 0 to about 8 percent rhenium, from 0 to about 6 percent ruthenium, from 0 to about 1 percent niobium, from 0 to about 0.1 percent carbon, from 0 to about 0.01 percent boron, from 0 to about 0.1 percent yttrium, balance nickel and incidental impurities.

2. The article of claim 1, wherein the article is a turbine blade.

3. The article of claim 1, wherein the article is a turbine vane.

4. The article of claim 1, wherein the modifying element is hafnium.

5. The article of claim 1, wherein the modifying element is zirconium.

6. The article of claim 1, wherein the modifying element is a combination of hafnium and zirconium.

7. The article of claim 1, wherein the base alloy composition is selected from the group consisting of a nominal composition in weight percent of about 7.5 percent cobalt, about 7 percent chromium, about 6.2 percent aluminum, about 6.5 percent tantalum, about 5 percent tungsten, about 1.5 percent molybdenum, about 3 percent rhenium, about 0.05 percent carbon, about 0.004 percent boron, about 0.15 percent hafnium, up to about 0.01 percent yttrium, balance nickel and incidental impurities;

a nominal composition in weight percent of about 12.5 percent cobalt, about 4.2 percent chromium, about 1.4 percent molybdenum, about 5.75 percent tungsten, about 5.4 percent rhenium, about 7.2 percent tantalum, about 5.75 percent aluminum, about 0.15 percent hafnium, about 0.05 percent carbon, about 0.004 percent boron, about 0.01 percent yttrium, balance nickel and incidental impurities;

a nominal composition in weight percent of about 9.6 percent cobalt, about 6.6 percent chromium, about 0.60 percent molybdenum, about 6.4 percent tungsten, about 3.0 percent rhenium, about 6.5 percent tantalum, about 5.6 percent aluminum, about 1.0 percent titanium, about 0.10 percent hafnium, balance nickel and incidental impurities;

a nominal composition in weight percent of about 7.00 percent cobalt, about 2.65 percent chromium, about 0.60 percent molybdenum, about 6.40 percent tungsten, about 5.50 percent rhenium, about 7.5 percent tantalum, about 5.80 percent aluminum, about 0.80 percent titanium, about 0.06 percent hafnium, about 0.4 percent niobium, balance nickel and incidental impurities;

a nominal composition in weight percent of about 5.00 percent cobalt, about 10.0 percent chromium, about 4.00 percent tungsten, about 12.0 percent tantalum, about 5.00 percent aluminum, about 1.5 percent titanium, balance nickel and incidental impurities;

a nominal composition in weight percent of about 10.00 percent cobalt, about 5.00 percent chromium, about 2.00 percent molybdenum, about 6.00 percent tungsten, about 3.00 percent rhenium, about 8.70 percent tantalum, about 5.60 percent aluminum, about 0.10 percent hafnium, balance nickel and incidental impurities; and, a nominal composition in weight percent of from about 0.4 to about 6.5 percent ruthenium, from about 4.5 to about 5.75 percent rhenium, from about 5.8 to about 10.7 percent tantalum, from about 4.25 to about 17.0 percent cobalt, from 0 to about 0.05 percent hafnium, from 0 to about 0.06 percent carbon, from 0 to about 0.01 percent boron, from 0 to about 0.02 percent yttrium, from about 0.9 to about 2.0 percent molybdenum, from about 1.25 to about 6.0 percent chromium, from 0 to about 1.0 percent niobium, from about 5.0 to about 6.6 percent aluminum, from 0 to about 1.0 percent titanium, from about 3.0 to about 7.5 percent tungsten, and wherein the sum of molybdenum plus chromium plus niobium is from about 2.15 to about 9.0 percent, and wherein the sum of aluminum plus titanium plus tungsten is from about 8.0 to about 15.1 percent, balance nickel and incidental impurities.

8. The article of claim 1, wherein the base alloy composition has a nominal composition in weight percent of about 7.5 percent cobalt, about 7 percent chromium, about 6.2 percent aluminum, about 6.5 percent tantalum, about 5 percent tungsten, about 1.5 percent molybdenum, about 3 percent rhenium, about 0.05 percent carbon, about 0.004 percent boron, about 0.15 percent hafnium, up to about 0.01 percent yttrium, balance nickel and incidental impurities.

9. The article of claim 1, wherein the base alloy composition has a nominal composition in weight percent of about 12.5 percent cobalt, about 4.2 percent chromium, about 1.4 percent molybdenum, about 5.75 percent tungsten, about 5.4 percent rhenium, about 7.2 percent tantalum, about 5.75 percent aluminum, about 0.15 percent hafnium, about 0.05 percent carbon, about 0.004 percent boron, about 0.01 percent yttrium, balance nickel and incidental impurities.

10. The article of claim 1, wherein the base alloy composition has a nominal composition in weight percent of about 9.6 percent cobalt, about 6.6 percent chromium, about 0.60 percent molybdenum, about 6.4 percent tungsten, about 3.0 percent rhenium, about 6.5 percent tantalum, about 5.6 percent aluminum, about 1.0 percent titanium, about 0.10 percent hafnium, balance nickel and incidental impurities.

11. The article of claim 1, wherein the base alloy composition has a nominal composition in weight percent of about 7.00 percent cobalt, about 2.65 percent chromium, about 0.60 percent molybdenum, about 6.40 percent tungsten, about 5.50 percent rhenium, about 7.5 percent tantalum, about 5.80 percent aluminum, about 0.80 percent titanium, about 0.06 percent hafnium, about 0.4 percent niobium, balance nickel and incidental impurities.

12. The article of claim 1, wherein the base alloy composition has a nominal composition in weight percent of about 5.00 percent cobalt, about 10.0 percent chromium, about 4.00 percent tungsten, about 12.0 percent tantalum, about 5.00 percent aluminum, about 1.5 percent titanium, balance nickel and incidental impurities.

13. The article of claim 1, wherein the base alloy composition has a nominal composition in weight percent of about 10.00 percent cobalt, about 5.00 percent chromium, about 2.00 percent molybdenum, about 6.00 percent tungsten, about 3.00 percent rhenium, about 8.70 percent tantalum, about 5.60 percent aluminum, about 0.10 percent hafnium, balance nickel and incidental impurities.

14. The article of claim 1, wherein the base alloy composition has a nominal composition in weight percent of from about 0.4 to about 6.5 percent ruthenium, from about 4.5 to about 5.75 percent rhenium, from about 5.8 to about 10.7 percent tantalum, from about 4.25 to about 17.0 percent cobalt, from 0 to about 0.05 percent hafnium, from 0 to about 0.06 percent carbon, from 0 to about 0.01 percent boron, from 0 to about 0.02 percent yttrium, from about 0.9 to about 2.0 percent molybdenum, from about 1.25 to about 6.0 percent chromium, from 0 to about 1.0 percent niobium, from about 5.0 to about 6.6 percent aluminum, from 0 to about 1.0 percent titanium, from about 3.0 to about 7.5 percent tungsten, and wherein the sum of molybdenum plus chromium plus niobium is from about 2.15 to about 9.0 percent, and wherein the sum of aluminum plus titanium plus tungsten is from about 8.0 to about 15.1 percent, balance nickel and incidental impurities.

15. The article of claim 1, wherein the article has a composition in weight percent of from about 0.25 to about 0.5 percent by weight zirconium, about 7.5 percent cobalt, about 7 percent chromium, about 6.2 percent aluminum, about 6.5 percent tantalum, about 5 percent tungsten, about 1.5 percent molybdenum, about 3 percent rhenium, about 0.05 percent carbon, about 0.004 percent boron, up to about 0.01 percent yttrium, balance nickel and incidental impurities.

16. The article of claim 1, wherein the article has a composition in weight percent of from about 0.2 to about 2.0 percent by weight hafnium, from about 0.25 to about 0.5 percent by weight zirconium, about 7.5 percent cobalt, about 7 percent chromium, about 6.2 percent aluminum, about 6.5 percent tantalum, about 5 percent tungsten, about 1.5 percent molybdenum, about 3 percent rhenium, about 0.05 percent carbon, about 0.004 percent boron, about 0.15 percent hafnium, up to about 0.01 percent yttrium, balance nickel and incidental impurities.

17. The article of claim 1, wherein the article has a composition in weight percent of from about 1.0 to about 2.0 percent by weight hafnium, from about 0.1 to about 0.5 percent by weight zirconium, from about 0.1 to about 0.5 percent by weight zirconium, about 7.5 percent cobalt, about 7 percent chromium, about 6.2 percent aluminum, about 6.5 percent tantalum, about 5 percent tungsten, about 1.5 percent molybdenum, about 3 percent rhenium, about 0.05 percent carbon, about 0.004 percent boron, up to about 0.01 percent yttrium, balance nickel and incidental impurities.

18. The article of claim 1, wherein the article has a composition in weight percent of from about 0.25 to about 0.5 percent by weight zirconium, about 12.5 percent cobalt, about 4.2 percent chromium, about 1.4 percent molybdenum, about 5.75 percent tungsten, about 5.4 percent rhenium, about 7.2 percent tantalum, about 5.75 percent aluminum, about 0.05 percent carbon, about 0.004 percent boron, about 0.01 percent yttrium, balance nickel and incidental impurities.

19. The article of claim 1, wherein the article has a composition in weight percent of from about 0.2 to about 2.0 percent by weight hafnium, from about 0.25 to about 0.5 percent by weight zirconium, about 12.5 percent cobalt, about 4.2 percent chromium, about 1.4 percent molybdenum, about 5.75 percent tungsten, about 5.4 percent rhenium, about 7.2 percent tantalum, about 5.75 percent aluminum, about 0.15 percent hafnium, about 0.05 percent carbon, about 0.004 percent boron, about 0.01 percent yttrium, balance nickel and incidental impurities.

20. The article of claim 1, wherein the article has a composition in weight percent of from about 1.0 to about 2.0 percent by weight hafnium, from about 0.1 to about 0.5 percent by weight zirconium, from about 0.1 to about 0.5 percent by weight zirconium, about 12.5 percent cobalt, about 4.2 percent chromium, about 1.4 percent molybdenum, about 5.75 percent tungsten, about 5.4 percent rhenium, about 7.2 percent tantalum, about 5.75 percent aluminum, about 0.05 percent carbon, about 0.004 percent boron, about 0.01 percent yttrium, balance nickel and incidental impurities.

21. The article of claim 1, wherein the modifying element is about 0.25 percent by weight zirconium.

22. The article of claim 1, wherein the modifying element is the combination of about 1.0 percent hafnium and from about 0.1 to about 0.5 percent by weight zirconium.

23. A composition of matter consisting essentially of, in weight percent:

a modifying element selected from the group consisting of from about 0.25 to about 0.5 percent by weight zirconium, combinations of from about 0.2 to about 2.0 percent by weight hafnium and from about 0.25 to about 0.5 percent by weight zirconium, and combinations of from about 1.0 to about 2.0 percent by weight hafnium and from about 0.1 to about 0.5 percent by weight zirconium; and a base alloy composition of from about 0.4 to about 6.5 percent ruthenium, from about 4.5 to about 5.75 percent rhenium, from about 5.8 to about 10.7 percent tantalum, from about 4.25 to about 17.0 percent cobalt, from 0 to about 0.06 percent carbon, from 0 to about 0.01 percent boron, from 0 to about 0.02 percent yttrium, from about 0.9 to about 2.0 percent molybdenum, from about 1.25 to about 6.0 percent chromium, from 0 to about 1.0 percent niobium, from about 5.0 to about 6.6 percent aluminum, from 0 to about 1.0 percent titanium, from about 3.0 to about 7.5 percent tungsten, and wherein the sum of molybdenum plus chromium plus niobium is from about 2.15 to about 9.0 percent, and wherein the sum of aluminum plus titanium plus tungsten is from about 8.0 to about 15.1 percent, balance nickel and incidental impurities.

24. An article comprising substantially a single crystal, and not a random polycrystal or an oriented polycrystal produced by directional solidification, and having a composition, in weight percent, consisting essentially of a modifying element selected from the group consisting of from about 0.25 to about 0.5 percent by weight zirconium, combinations of from about 0.2 to about 2.0 percent by weight hafnium and from about 0.25 to about 0.5 percent by weight zirconium, and combinations of from about 1.0 to about 2.0 percent by weight hafnium and from about 0.1 to about 0.5 percent by weight zirconium; and a base alloy composition of from about 4 to about 20 percent cobalt, from about 1 to about 10 percent chromium, from about 5 to about 7 percent aluminum, from 0 to about 2 percent molybdenum, from about 3 to about 8 percent tungsten, from about 4 to about 12 percent tantalum, from 0 to about 2 percent titanium, from 0 to about 8 percent rhenium, from 0 to about 6 percent ruthenium, from 0 to about 1 percent niobium, from 0 to about 0.1 percent carbon, from 0 to about 0.01 percent boron, from 0 to about 0.1 percent yttrium, balance nickel and incidental impurities.

* * * * *